United States Patent [19]

Dogliotti

[11] 4,163,496

[45] Aug. 7, 1979

[54] CONTAINER FOR DISPENSING SMALL OBJECTS

[75] Inventor: Amilcare Dogliotti, Alba, Italy

[73] Assignee: P. Ferrero & C. S.p.A., Alba, Italy

[21] Appl. No.: 838,176

[22] Filed: Sep. 30, 1977

[30] Foreign Application Priority Data

Oct. 4, 1976 [IT] Italy ..... 69380 A/76

[51] Int. Cl.[2] ..... B65D 85/60; B65D 43/16

[52] U.S. Cl. ..... 206/538; 220/306; 220/339

[58] Field of Search ..... 206/538; 220/22, 339, 220/375, 306

[56] References Cited

U.S. PATENT DOCUMENTS

| | | | |
|---|---|---|---|
| 2,418,578 | 4/1947 | Crane | 220/306 |
| 2,747,388 | 5/1956 | Dolar | 220/22 |
| 3,018,917 | 1/1962 | Breitmayer | 220/375 |
| 3,872,996 | 3/1975 | Dogliotti | 220/339 |
| 3,968,880 | 7/1976 | Ostrowsky | 220/306 |

FOREIGN PATENT DOCUMENTS

| | | | |
|---|---|---|---|
| 156287 | 3/1973 | Italy | 220/339 |
| 893036 | 4/1962 | United Kingdom | 220/339 |

*Primary Examiner*—William T. Dixson, Jr.
*Attorney, Agent, or Firm*—Sughrue, Rothwell, Mion, Zinn and Macpeak

[57] ABSTRACT

A container for holding and dispensing small objects such as confectionery articles, comprising a body forming a box open at one end into which is snap engageable a closure element having two tongues or flaps aligned with, but directed away from, one another. The two tongues are joined to a bridge of the closure element by ligament-type hinges and are integrally formed with the closure element; at the free ends of the tongues there are snap engagement means which hold the tongues tightly shut and sealed in the openings in the closure element, which latter is itself sealed in the mouth of the body of the container.

18 Claims, 5 Drawing Figures

CONTAINER FOR DISPENSING SMALL OBJECTS

The present invention relates to containers for small objects and in particular to small portable containers intended to be carried in a pocket and to contain pastilles or like confectionery products. Embodiments of the present invention can be so constructed that they can be held in the hand and opened or closed by the user with the same hand.

Containers of this general type are known, they are made by means of injection moulding, in plastics material, and provided at or near the top with an aperture closed by a flap hinged to the wall at the top of the container by means of a so-called integral hinge formed during the injection moulding of the container itself. The end of the flap remote from the hinge projects slightly over the side of the container and constitutes a gripping projection for engagement by the thumb; snap engagement means are provided for maintaining the flap in its closed position.

The flap closure systems up till now used on this type of container have not been entirely satisfactory, however, in that perfect sealing of the container by closure of the aperture of the container by the flap could not be obtained; this was a considerable disadvantage, particularly in circumstances where the containers were intended to contain pastilles or like confectionery products which were subject to deterioration upon contact with the atmosphere. It was therefore necessary, in order to ensure that the products did not deteriorate before they could be used, particularly when they were for sale in regions having adverse climatic conditions, to apply to the pastilles one or more protective coatings; this, however, was not always welcomed by the consumers.

The technical problem which the present invention seeks to solve is that of providing a container having a flap closure of the type generally described above, in which the closure is such that it can form an hermetic seal of the container when closed.

The present invention also seeks to provide, at least in some embodiments, a closure suitable to contain two different types of products, which latter can be selectively taken from the container through two separate apertures. Such a container has two separate compartments which are isolated from one another.

According to the present invention there is provided a container for holding and dispensing a plurality of small objects, comprising:

(a) a hollow body having at least two larger side walls and two smaller side walls closed at one end by a bottom wall and having a mouth open at the end opposite the bottom wall;

(b) a hollow closure element of plastics material having a cross section substantially the same as that of the body, and including a main part in the form of a skirt having at least one aperture passing therethrough, the said closure element being shaped such that it can be assembled to the body of the container to close the mouth thereof;

(c) a tongue for the closure of the or each aperture in the said closure element, the said tongue being formed integrally with the closure element and being hinged, by means of a portion thereof of reduced section, to the main part of the closure element;

(d) the said closure element providing a seat adapted to receive the free end of the tongue in its closure position;

(e) the said tongue having a projecting part at the free end thereof opposite the said hinge, which extends axially beyond the said seat of the closure element for engagement by the thumb of a user in opening the container;

(f) cooperating snap engagement means carried by the outer surface of the skirt of the closure element adjacent the said seat, and by a transverse ridge projecting from the said free end of the tongue and extending in a direction parallel to the said hinging axis of the tongue, for retaining the tongue in its closure position;

(g) the said tongue and its transverse ridge constituting a rigid element which is sufficiently stiff not to be deformed by forces applied to the said projecting part of the tongue during the operations of opening and closing the container, such that during such operations the portion of reduced cross section of the tongue constituting the hinge thereof reacts elastically in the manner of a spring to displacing forces applied to the tongue by the snap engagement means;

(h) the distance A from the hinging axis of the tongue to the coupling surface of the snap engagement means carried by the transverse ridge on the tongue being less than the distance B from the hinging axis of the tongue to the coupling surface of the cooperating snap engagement means carried by the outer surface of the skirt of the closure element such that, in the closure position of the tongue it is displaced by a distance equal to this difference and the portion of the tongue constituting the integral hinge is elastically stretched to accommodate this displacement.

In a preferred embodiment of the present invention the main part of the closure element is provided with two apertures separated by a crosspiece formed integrally with the closure element and extending between the two longer sides of the main part thereof.

Preferably the crosspiece forms part of a partition which extends to the bottom wall of the body of the container and subdivides the container into two compartments.

One embodiment of the present invention will now be more particularly described, by way of example, with reference to the accompanying drawings, in which.

Figure 1:
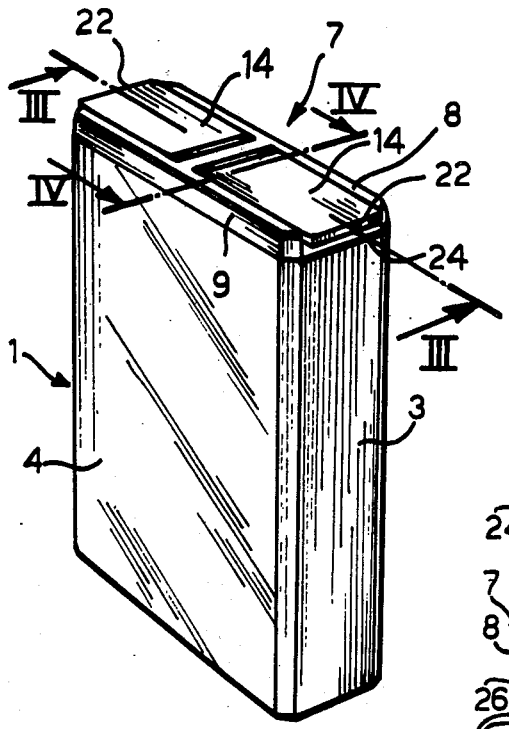
FIG. 1 is a perspective view of a container formed as an embodiment of the present invention.

Referring now to the drawings, and particularly to FIG. 1, there is shown a substantially parallelipiped container the dimensions of which are such that it can be comfortably contained in the palm of a hand. The main part of the container is constituted by a body 1 formed by injection moulding of a substantially rigid transparent plastics material such as polystyrene. The body 1 is hollow and has a bottom wall 2, two smaller side walls 3 and two larger side walls 4. The smaller walls 3 are each provided, near their upper edges with a set of substantially parallel grooves 5 on their inner surfaces.

The interior of the body 1 of the container is divided into two chambers by an intermediate wall 6 the upper edge of which is at a lower level than the upper edges of the side walls 3 and 4 of the body 1. The mouth of the container body 1 is closed by a closure element 7 which fits into the upper mouth of the body 1 in the manner of a plug.

The closure element 7 is made of plastics material, preferably opaque, which is injection moulded in a single piece. The opaque plastics material from which the closure element is made is more flexible than the plastics material from which the body 1 is made; a suitable material for the closure element 7 is, for example, polyvinylchloride.

The main part of the closure element 7, indicated with the reference numeral 8, is in the form of a skirt having an upper part 9 and a lower part 10. The lower part 10 has a height greater than that of the upper part 9 which is distinguished therefrom by the fact that the walls of the upper part 9 are substantially thicker than the walls of the lower part 10, although the inner surfaces of the two parts are substantially coplanar. This means that the outer surfaces of the two parts are displaced from one another in a direction transverse the general plane of the walls, and meet at a step or shoulder 11 the surface of which is generally perpendicular to the surface of the wall of the lower part 10 and which constitutes the abutment surface of the closure element 7 against the upper edge of the side walls 3, 4 of the body 1 when the closure element 7 is introduced into the mouth at the open end of the body 1.

The lower part 10 of the skirt forming the main part of the closure element 7 has two larger walls and two smaller walls, which latter are provided on their outer surfaces with respective sets of substantially parallel generally horizontal ribs 12 which, when the closure element 7 is introduced into the mouth of the body 1, snap engage into the corresponding grooves 5 in the smaller walls of the body 1 for the purpose of retaining the closure element 7 in place in the body 1. This snap engagement resists any upwardly directed forces which may be applied to the closure element 7 and which could otherwise cause it to be displaced from the body 1. The main part 8 of the closure element 7 is shaped to define two apertures 13 each of which extends parallel to the length of the main part 8 and each extending from one of its shorter walls towards the other. The adjacent ends of the two apertures are defined by a crosspiece 16 which extends between the two longer walls of the main part 8 of the closure element 7 parallel to the two shorter walls of the main part 8 and mid-way between them. Hinged to the crosspiece 16 are two tongues or flaps 14 serving for the closure of the two apertures 13. Each tongue 14 is in the form of a plate with plane parallel faces and is formed integrally with the element 7 to which it is hinged, by a portion 15 of reduced cross section, to the crosspiece 16.

Figure 3:
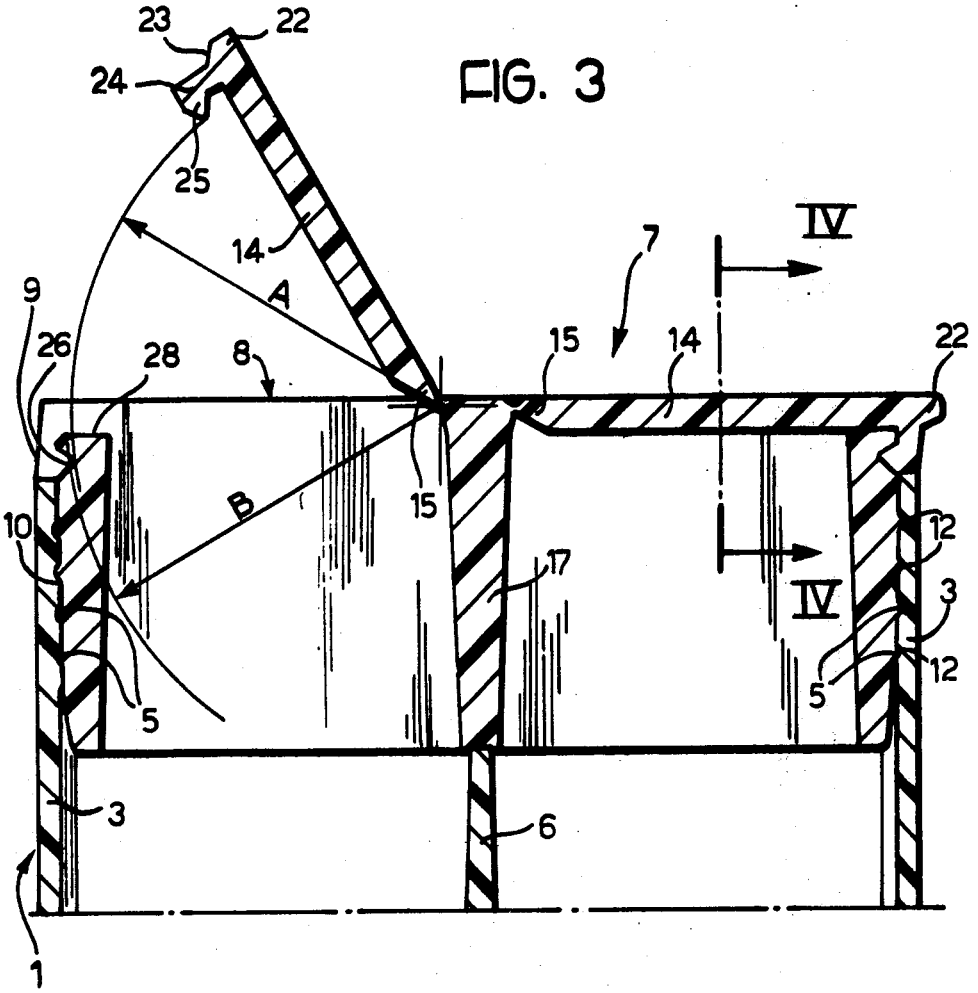
FIGS. 3 and 4 are two transverse sections on a larger scale, respectively taken on the lines III—III and IV—IV of FIG. 1.

The crosspiece 16 forms part of a partition which constitutes an intermediate wall 17 of the closure element 7. The intermediate wall 17 has a thickness which decreases towards its lower edge, which latter lies at the same level as the lower edge of the lower part 10 of the skirt forming the main part 8 of the closure element 7. As is illustrated in FIG. 3, when the closure element 7 is snap engaged into the mouth of the body 1, the lower edge of the intermediate wall 17 of the closure element 7 contacts the upper edge of the intermediate wall 6 of the body 1. As can be seen the thickness of the lower edge of the intermediate wall 17 of the closure element 7 is greater than the thickness of the upper edge of the intermediate wall 6 of the body 1. The heights of the intermediate wall 17 of the closure element 7 and the intermediate wall 6 of the body 1 are such that in the assembled state of the container, with the ribs 12 of the element 7 snapped into the grooves 5 of the body 1, the said two intermediate walls are in a state of slight compression due to their contact with one another. The two chambers into which the container is subdivided by the intermediate walls 6 and 17 are thus sealed from one another.

The portion 15 of reduced cross section of each tongue 14, by means of which each tongue 14 is hinged to the crosspiece 16, is defined by two notches, one formed in the lower surface and one formed in the upper surface of the tongue; these notches extend across the width of the tongue itself. The lower notch has a V-profile one side 18 of which (the side nearest the free edge of the tongue) has an angle of inclination, with respect to the plane of the lower face of the tongue, which is substantially less than the angle of inclination of the other side 19 of the notch with respect to the plane of the lower face of the tongue. For example, the inclination with respect to a horizontal plane of the side 18 shown in FIG. 3 is of the order of 30° and the inclination of the side 19 is of the order of 75°.

The depth of the notch 18, 19 in the lower face of the tongue 14 is substantially equal to half the thickness of the tongue 14. The thickness of the tongue 14 is chosen, in relation to the elastic properties of the material of which it is made to be such that the tongue is sufficiently rigid that it does not bend under the action of the forces exerted on it during the operations of opening and closing the container. A thickness of the order of 1.5 mm is found to be convenient for attaining this.

The notch which extends across the upper face of each tongue 14 has a width and a depth substantially less than that of the notch in the lower face. In the example illustrated the upper notch also has a generally V-shape cross section comprising a rectilinear side 20 (which is nearest the free end of the tongue 14) and a curved side 21 having a generally circular profile. The rectilinear side 20 has an inclination in the region of 30° with respect to the plane of the upper face of the tongue 14; and the semicircular side 21 is defined by an arc of a circle having its centre located on the upper face of the tongue 14 and on a vertical extending from the lower edge of the inclined rectilinear side 20. The depth of the upper notch of the tongue is approximately one fifth of the thickness of the tongue 14.

Figure 5:
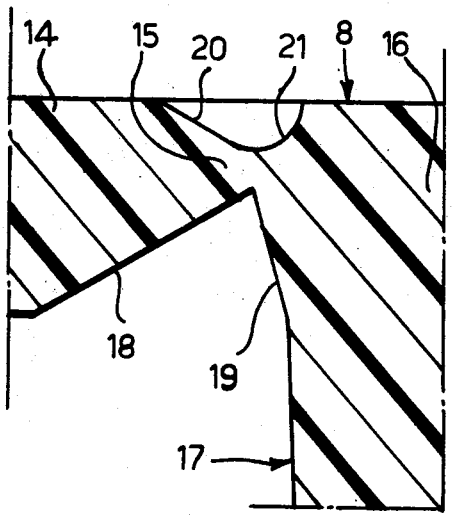
FIG. 5 is a detail, on a greater scale, of a part of FIG. 3.

As can be seen from FIG. 5, not only the depth but also the width or axial extent, (that is the extent in the direction of the length of the tongue 14) of the upper notch is substantially less than the width of the lower notch. In particular, in the example illustrated, the width of the upper notch is in the region of half the width of the lower notch.

Because of the conformation of the integral hinges described above, constituted by the restricted section 15 of each tongue 14, by which each tongue is connected to the crosspiece 16, these hinges also each serve as a spring when the associated tongue 14 is subjected to a displacing force along its longitudinal axis directed towards the hinge from its free end. Such forces are applied to the tongue 14 when the tongue is closed into the main portion 8 of the closure element 7 as will be described in greater detail below. When such forces are applied the restricted section 15 deforms elastically, allowing the tongue to be displaced in an axial sense (that is along its length) and biases the tongue towards the initial rest position, to which latter position it is returned as soon as the displacing force is removed. This is particularly advantageous for the achievement of the aims of the present invention as will become apparent in the following description.

Figure 2:
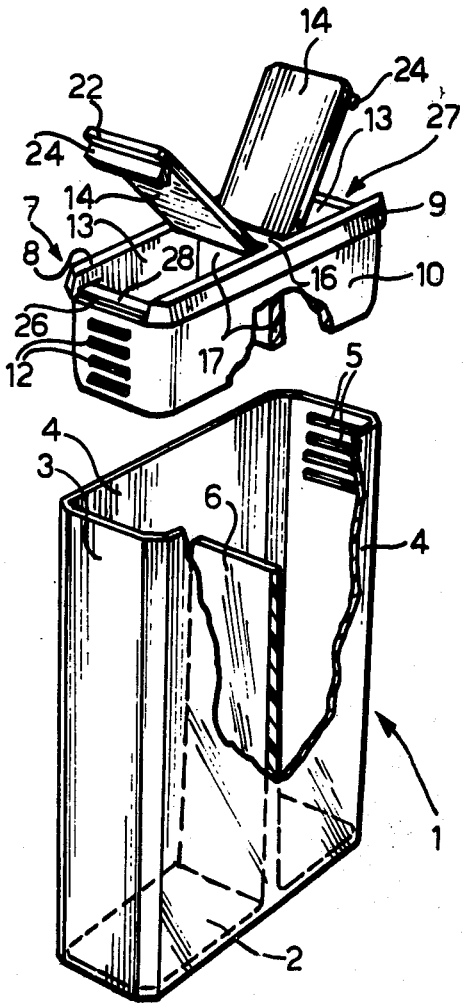
FIG. 2 is an exploded perspective view of the embodiment illustrated in FIG. 1.

When in the closed position, the tongue projects slightly over the edge of the main part 8 of the closure element. The projecting part of the tongue, indicated 22, has a lower inclined surface 23 against which the thumb of a user presses in the operation of opening the container. Each tongue 14 is also provided at its outer end with a transverse ridge 24 which projects from its lower face. In the example illustrated in FIG. 2 each ridge has a length equal to the width of the tongue 14 on which it is carried; however the length of each ridge may be more or less than this width. The thickness of the transverse ridge 24 is such that the tongue 14 and the ridge 24 together constitute a rigid element which is sufficiently stiff as to be not deformed under the effects of the forces applied to the tongue during the operations of opening and closing the container.

The transverse ridge 24 is provided on its internal surface, that is the surface facing the hinge end of the tongue 14, with a tooth 25 having a substantially trapezoidal profile and extending parallel to the hinging axis of the tongue. Correspondingly, in the upper part 9 of the skirt of the closure element 7 there is formed, in each of the smaller sides, a groove 26 having a profile complementary to that of the tooth 25. In addition, each of the smaller sides of the part 9 of the skirt of the closure element 7 is provided, on its upper edge, with a recess 27 having a width and a depth corresponding to the width and the thickness of the tongue 14. The bottom wall of this recess, indicated 28, constitutes an abutment surface for the free end of the tongue in its closed position.

Figure 4:
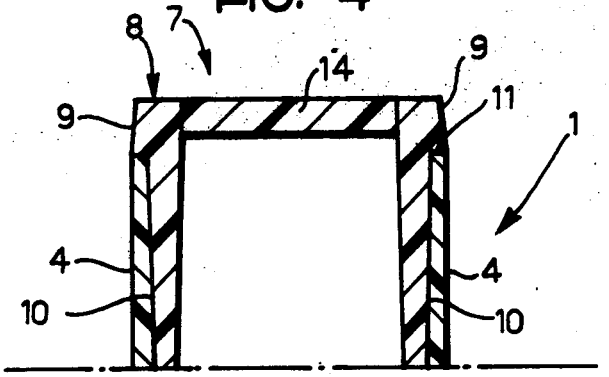

As is illustrated in particular in FIG. 4, the sides of each tongue 14 engage tightly, in the closed position of the tongue, between the inner surfaces of the adjacent walls of the closure element 7.

As can be seen from FIG. 3 the distance A from the edge of the tooth 25 to the hinging axis of the associated tongue 14 is slightly less than the distance B from the corresponding coupling surface of the groove 26 to the hinging axis of the tongue. Because of this, and also because of the elasticity of the restricted zone 15 forming the hinge itself, the restricted zone 15 can deform lengthwise elastically when, during the operation of opening or closing the container, the tooth 25 has to pass over the outer edge of the abutment surface 28 in order subsequently to be able to snap engage into the groove 26; after the tooth 25 has engaged in the groove 26 the tongue 14 remains displaced by a small amount due to the difference between the two distances A, B discussed above, and this exerts on the tongue 14 a slight force along its length; the restricted portion 15 is elastically stretched under the effect of this force and this residual tension serves to pull the tooth 25 tightly into contact with the groove 26.

The residual tension, being directed along the length of the tongue, ensures, together with the above mentioned lack of play between the sides of the tongue and the inner surfaces of the closure element 7 adjacent to the lateral sides of the tongue, that the closure obtained by means of each tongue 14 forms a perfect seal. Because the assembly constituted by each tongue 14 and its associated transverse ridge 24 cannot be deformed by the forces involved, the tooth 25 thus remains in close form contact with the groove 26. Likewise, this is aided by the stiffness of the tongue 14 due to its thickness, which prevents the tongue 14 itself from being deformed under the action of the forces imparted to the tongue 14 during the opening operation, in which the axial component of the thrust exerted by the thumb would tend, if the tongue were not sufficiently stiff, to bend this upwardly.

From the preceding description it will be seen how the container described above provides a satisfactory solution to the problem of obtaining sealing closure of the interior of the container by each of the tongues 14. If, as is illustrated in the example, the container is divided into two separately sealed chambers by a partition such as the dividing walls 6 and 17 which are maintained in relative contact under pressure, it is possible to utilise a container formed as an embodiment of the present invention to contain, for example, two types of pastilles, or other confectionery products having different flavours because it can be ensured that during the storage of the product, there will neither be any transfer to the aroma of one product from one chamber to the other of the container, nor any contamination of the products contained in the chambers by the external atmosphere.

The provision of two tongues 14 in opposed positions can be useful even on containers which are not provided with an intermediate dividing wall and which, therefore, are intended to contain only a single type of product. In fact, in such a case the user, after having grasped the container with a hand, can open the container with the thumb of the same hand without it being necessary to rotate the container through 180° as was necessary with the previously known containers, which were provided with only a single aperture for the discharge of products, when the container was grasped in such a way that the free end of the tongue was directed towards the inside of the hand instead of towards the thumb.

This property of containers according to the invention is particularly useful in certain cases, for example if it were desired to consume the products whilst driving a motor vehicle.

In the example described above there has been illustrated a prismatic container having a substantially rectangular cross section. Clearly the invention can be applied also to containers the transverse section of which is not constant throughout the height of the container itself, for example to containers having a cross section which reduces slightly towards one end, either towards the base or the top, or to containers having their smaller sides slightly curved.

It will also be clear to those skilled in this art that, in the case of containers provided with an intermediate wall which separates the interior of the container into two sealed chambers, each chamber being provided with its own closure device, the said dividing wall could be formed in a different manner from that described and illustrated a ove.

Although in the exemplary embodiment described with reference to the drawings, use is made of a closure element 7 for the body 1 of the container in the form of a plug penetrating into the mouth of the body 1, the invention can be equally applied to the case in which the said closure element is in the form of a cap intended to be applied over the mouth in the upper part of the container body.

What is claimed is:

1. A container for holding and dispensing a plurality of small objects, said container comprising, in combination:

a hollow body having at least two larger side walls and two smaller side walls closed at one end by a bottom wall, said side walls defining a mouth open at the end of said container opposite said bottom wall;

a hollow closure element of plastics material having a cross sectional shape substantially the same as that of said hollow body, said hollow closure element having a main part in the form of a skirt the sides of which define at least one aperture passing through said closure element from top to bottom, said closure element being shaped such that it can be assembled to said hollow body of said container to close said mouth thereof;

a tongue for the closure of said at least one aperture of said closure element, said tongue being formed integrally with said closure element, and a portion of said tongue being of reduced section with respect to the main part of said tongue and serving as a hinge joining said tongue to said main part of said closure element; said tongue being in the form of a plate having plane parallel faces and said portion of reduced cross section constituting said integral hinge being defined by a first transverse notch, v-shaped in cross section, formed in the lower surface of said tongue, and a second transverse notch formed in the upper surface of said tongue at a position opposite said first notch; said second notch having a depth and width substantially less than that of said first notch;

means defining a seat on said closure element adapted to receive the free end of said tongue remote from said hinge in the closure position of said tongue;

a projecting part of said free end of said tongue extending beyond said seat of said closure element and providing means for engagement by the thumb of a user in opening said container;

a transverse ridge projecting from the under surface of and spaced inwardly from said free end of said tongue and extending in a direction parallel to said hinging axis of said tongue;

means defining cooperating snap engagement means, one part of which is carried by the outer surface of said skirt defining said main part of said closure element adjacent said seat, and the other part of which is carried by said transverse ridge projecting from said free end of said tongue, for retaining said tongue in its closure position, said tongue and said transverse ridge together constituting a rigid element which is sufficiently stiff not to be deformed by forces applied to said projecting part of said tongue during the operations of opening and closing said container such that, during such operations, said portion of reduced cross section of said tongue constituting the hinge thereof reacts elastically in the manner of a spring to displacing forces applied to said tongue by said snap engagement means, said hinging axis of said tongue being spaced from the coupling surface of said snap engagement means carried by said transverse ridge on said tongue a distance less than the distance said hinging axis of said tongue is spaced from the coupling surface of said cooperating snap engagement means carried by the outer surface of said skirt forming the main part of said closure element, whereby in the closure position of said tongue it is displaced by a distance equal to the difference between said distances so that the portion of said tongue constituting said integral hinge is elastically stretched to accommodate such displacement.

2. A container as in claim 1, wherein said snap engagment means include:

a tooth carried by that surface of said transverse ridge of said tongue facing said hinge end of said tongue; and a groove formed in the outer surface of the upper part of said skirt forming the main part of said closure element, said groove having a shape complementary to that of said tooth.

3. A container as in claim 2, wherein said tooth has a substantially trapezoidal shape.

4. A container as in claim 1, wherein the side of said first notch which faces towards said free end of said tongue has an inclination, with respect to the plane of the lower face of said tongue substantially less than that of the other side of said first notch.

5. A container as in claim 1, wherein said second notch is generally v-shaped in cross section and includes a substantially flat side facing towards said free end of said tongue and having an inclination with respect to the plane of the upper face of said tongue substantially equal to that of the corresponding side of said first notch, and a side which has a part-circular cross section.

6. A container as in claim 1, wherein the depth of said first notch is substantially equal to half the thickness of said tongue, and the depth of said second notch is substantially equal to one fifth of the thickness of said tongue.

7. A container as in claim 1, wherein the width of said second notch is in the region of half the width of said first notch.

8. A container as in claim 1, wherein said main part of said closure element is provided with two apertures, a crosspiece formed integrally with said closure element and extending between said two longer sides of said main part of said closure element separating said two apertures from one another.

9. A container as in claim 8, wherein said crosspiece has a height substantially equal to that of said skirt forming the main part of said closure element.

10. A container as in claim 9, wherein said crosspiece forms part of a partition which extends to said bottom wall of said body of said container and subdivides said container into two compartments.

11. A container as in claim 10, wherein said partition includes a first part which is formed as a part of said crosspiece and a second part which is formed as an intermediate wall integral with said body of said container.

12. A container as in claim 11, wherein said first part of said partition, which is formed as part of said crosspiece, constitutes an intermediate wall of said closure element.

13. A container as in claim 12, wherein said closure element is in the form of a plug adapted to be inserted into said mouth of said body of said container, and said intermediate wall of said closure element is connected to the inner surface of the longer side wall of said skirt constituting said main part of said closure element.

14. A container as in claim 12, wherein said intermediate walls of said closure element and said body respectively are aligned with one another, and the adjacent edges thereof are in close contact with one another when said closure element is assembled to said body of said container.

15. A container as in claim 14, wherein said intermediate wall of said closure element, and said intermediate wall of said body of said container both have a thickness which decreases towards the edges thereof which contact one another when said closure element is assembled to said container.

16. A container as in claim 14, wherein the thickness of said intermediate wall of said closure element at the edge thereof is greater than the thickness of the edge of said intermediate wall of said body.

17. A container as in claim 13, wherein the outer surface of said lower part of said skirt of said closure element, and the inner surface of said body are provided with snap engagement elements adapted to resist, when said closure element is assembled to said container, the separation of said closure element from said body; the height of said intermediate walls of said closure element and said body being such that when said closure element is assembled to said body of said container, said intermediate walls are in a state of slight compression.

18. A container as in claim 17, wherein the said snap engagement elements include means defining at least one groove in the inner surface of the shorter walls of said body and directed parallel to the shorter side of said bottom wall thereof, and at least one rib having a shape complementary to that of said groove, formed in the outer surface of the lower part of said skirt forming the main part of said closure element.

* * * * *